US010124501B2

(12) United States Patent
Fritz

(10) Patent No.: US 10,124,501 B2
(45) Date of Patent: Nov. 13, 2018

(54) CONCRETE CYLINDER MOLD CUTTER

(71) Applicant: Andrew W. Fritz, Winona, MN (US)

(72) Inventor: Andrew W. Fritz, Winona, MN (US)

( * ) Notice: Subject to any disclaimer, the term of this patent is extended or adjusted under 35 U.S.C. 154(b) by 129 days.

(21) Appl. No.: 15/082,674

(22) Filed: Mar. 28, 2016

(65) Prior Publication Data

US 2016/0311131 A1 Oct. 27, 2016

Related U.S. Application Data

(60) Provisional application No. 62/151,680, filed on Apr. 23, 2015.

(51) Int. Cl.

| | |
|---|---|
| ***B26D 1/08*** | (2006.01) |
| ***B28B 17/00*** | (2006.01) |
| ***B26D 1/09*** | (2006.01) |
| ***B26D 7/18*** | (2006.01) |
| ***B28B 7/34*** | (2006.01) |
| ***B26D 5/10*** | (2006.01) |

(52) U.S. Cl.

CPC ..... *B26D 1/08* (2013.01); *B26D 1/09* (2013.01); *B26D 5/10* (2013.01); *B26D 7/18* (2013.01); *B28B 7/342* (2013.01); *B28B 7/348* (2013.01); *B28B 17/0036* (2013.01); *B26D 2007/1809* (2013.01)

(58) Field of Classification Search

CPC . B26D 1/08; B26D 1/09; B26D 1/085; B26D 1/095; B26D 5/10; B26D 1/066; B26D 1/223; B28D 1/042

USPC ..... 125/16.03, 23.01

See application file for complete search history.

(56) References Cited

U.S. PATENT DOCUMENTS

| | | | | |
|---|---|---|---|---|
| 2,874,688 A * | 2/1959 | Biesanz, Sr. | ..... | B28D 1/223 125/23.01 |
| 3,886,927 A * | 6/1975 | Chattin | ..... | B28D 1/223 125/23.01 |
| 4,944,091 A * | 7/1990 | Johnson | ..... | A47J 43/26 30/120.2 |
| 8,689,778 B1 * | 4/2014 | Flores | ..... | B28D 1/223 125/23.01 |

FOREIGN PATENT DOCUMENTS

| | | | | |
|---|---|---|---|---|
| DE | 830473 C * | 2/1952 | ..... | B28D 1/223 |
| DE | 2523084 A1 * | 12/1975 | ..... | B26D 1/08 |

(Continued)

OTHER PUBLICATIONS

English Translation of DE10342713.*

*Primary Examiner* — Jennifer Swinney
(74) *Attorney, Agent, or Firm* — Vidas Arrett & Steinkraus; Richard A. Arrett

(57) ABSTRACT

An apparatus for removing the plastic mold around cured concrete in a plastic test specimen includes a baseplate with upstanding framework that supports two spaced vertical rods to which a cross-member is slidably mounted to move up and down the rods. At least one blade member is carried by the cross-member such that upon descent it may cut away the plastic of the mold so the cured concrete test cylinder may be removed. The cross-member is driven up and down by a lever arm pivotally mounted to the framework and includes a linkage between the lever arm and cross-member to transfer energy downward from the lever arm to cut and strip away the plastic mold from the concrete.

3 Claims, 2 Drawing Sheets

(56) References Cited

FOREIGN PATENT DOCUMENTS

| | | | | | |
|---|---|---|---|---|---|
| DE | 10342713 | A1 | * | 4/2005 | B26D 1/08 |
| DE | 202009012359 | | * | 2/2011 | B02C 18/02 |
| DE | 102013107248 | | * | 1/2015 | |
| EP | 0739692 | A1 | * | 10/1996 | B26D 1/08 |
| FR | 324026 | A | * | 3/1903 | B26D 1/09 |
| FR | 350853 | A | * | 6/1905 | B26D 1/08 |
| FR | 597602 | A | * | 11/1925 | B26D 1/085 |
| FR | 2551691 | A1 | * | 3/1985 | B23D 15/00 |
| GB | 1131567 | A | * | 10/1968 | B26D 1/08 |

* cited by examiner

CONCRETE CYLINDER MOLD CUTTER

CROSS-REFERENCE TO RELATED APPLICATIONS

This is a utility application conversion from U.S. provisional patent application No. 62/151,680 filed Apr. 23, 2015.

STATEMENT REGARDING FEDERALLY SPONSORED RESEARCH

Not Applicable

BACKGROUND OF THE INVENTION

Field of the Invention

This invention relates to concrete cylinder plastic mold test specimens to improve the method of removing concrete test specimen from 4"×8" plastic test cylinders safely and efficiently.

Description of the Related Art

In the construction industry, projects often must meet certain specifications and pass specified tests. Concrete construction requires samples of concrete to be taken and tested to strict standards. Standards being compression testing for concrete strength at specified ages representing actual field concrete strength, endure freeze thaw cycles and in depth testing for air content. On site collection of fresh concrete is placed in to cylinder molds, generally 4"×8" or 6"×12". Test cylinders are usually formed of plastic and are considered disposable. Samples are then allowed to harden or setup in the field. Specimens are then transported to a testing facility including but not limited to on site labs, concrete producers lab, state owned labs and independent testing firms with capabilities of testing concrete. The molds are stripped, cured for a period of time and then tested for strength, air and freeze-thaw cycles. Specimens are in the thousands in a given year.

The method used currently in the industry to strip the plastic mold is a hammer or rubber mallet striking a special sharpened/chisel point screw driver driving it down between the test specimen and plastic mold, cutting the mold as it driven down. This requires making numerous strikes with a hammer or rubber mallet to cut down 2 sides of the test specimen while being held between an operator's feet. This method has had numerous work related injuries to the operator and compromised the test specimens due to inadequate support of specimens.

BRIEF SUMMARY OF THE INVENTION

An objective of the stripping apparatus is to dually cut the plastic mold in a safe, timely and cost-effective manner. The invention is simple in design and is highly effective in operation for successive stripping of large quantities of cylinder molds with the convenience of the operator in mind.

A manual operated table top or pedestal mount concrete cylinder mold cutting apparatus specifically for 4"×8" plastic cylinder molds. Of course, any size molds may be used with an appropriately sized mold cutter of the invention. The apparatus is hand operated and uses mechanical linkage which increases the mechanical advantage or leverage applied to the cutters to cut plastic cylinder mold for the removal of concrete test specimen. Exerting sufficient effort to cut the plastic mold encasement without scoring, damaging or injuring concrete specimen.

BRIEF DESCRIPTION OF THE SEVERAL VIEWS OF THE DRAWING(S)

DETAILED DESCRIPTION OF THE INVENTION

Figure 2:
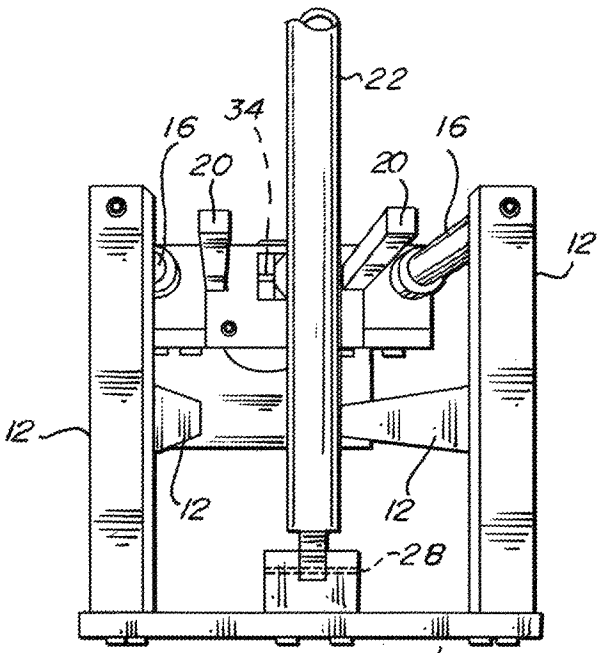
FIG. 2 is a top view of the present invention.
Figure 1:
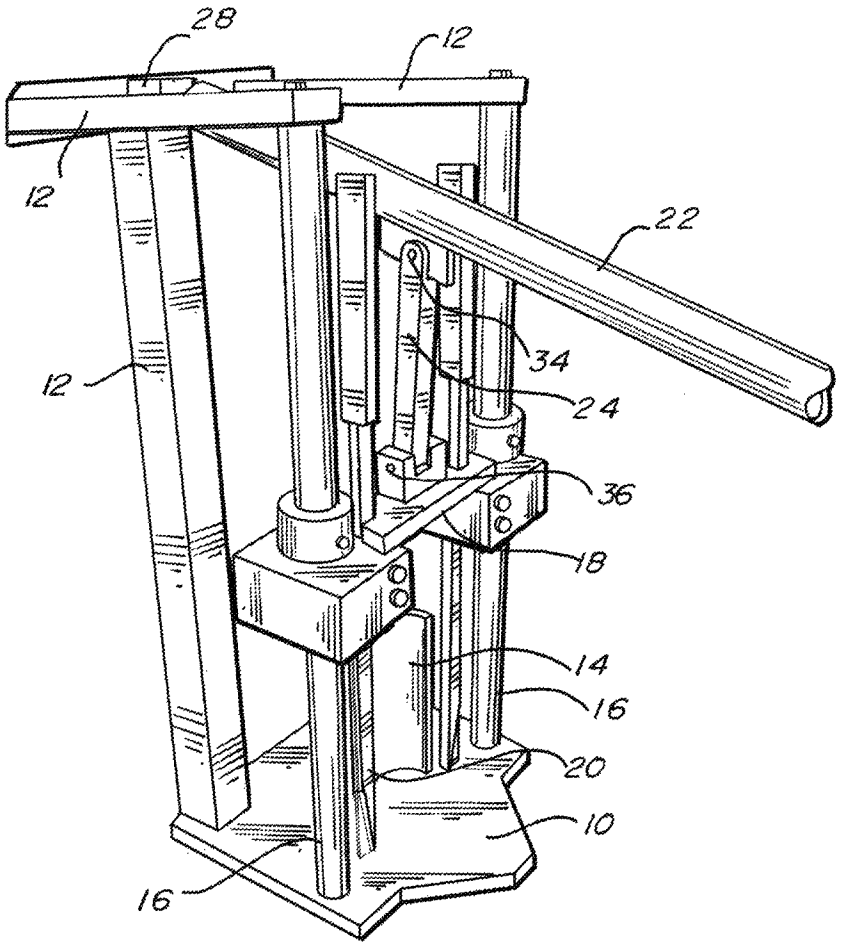
FIG. 1 is a perspective view of the present invention.
Figure 5:
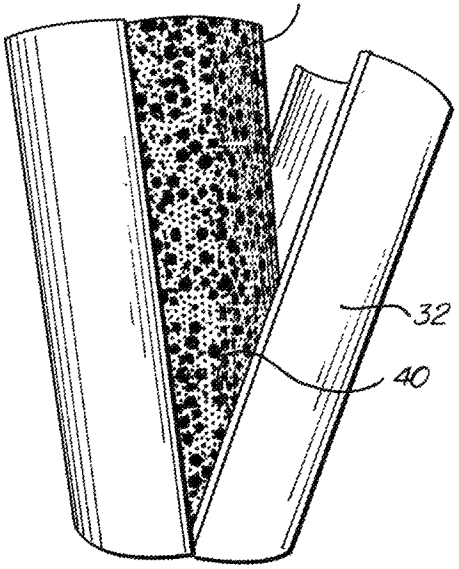
FIG. 5 is a perspective view of the result of the invention.
Figure 4:
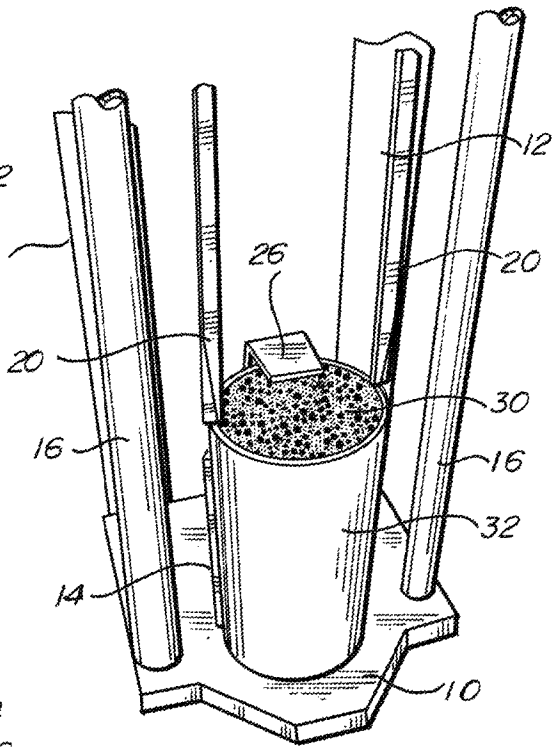
FIG. 4 is a perspective view with concrete filled cylinder mold test specimen in place of present invention.
Figure 3:
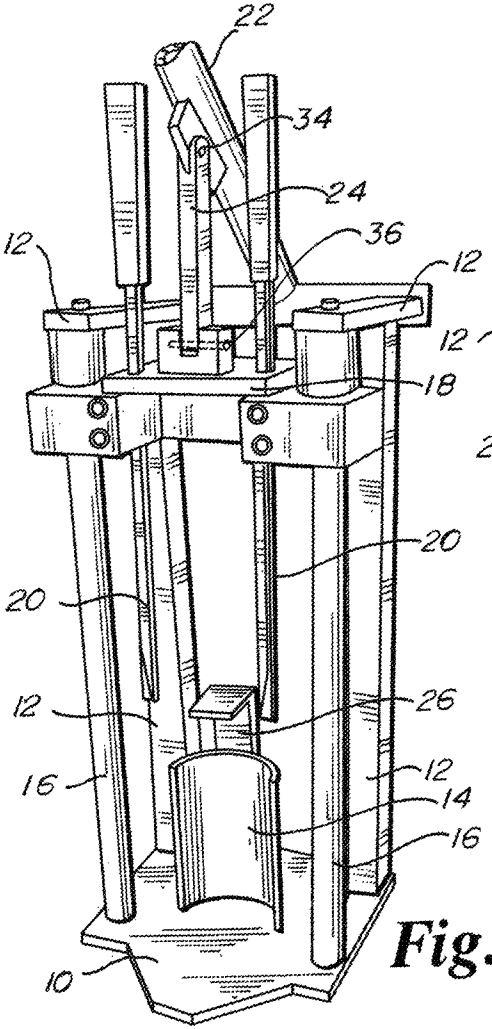
FIG. 3 is a perspective view of retracted position of the invention.

Referring now to the invention in more detail, FIG. 1 to FIG. 5, is composed of a baseplate 10 and frame work 12, having a base plate 10 for supporting a molded test specimen which is composed of concrete 30 and mold 32 to be split apart at splits shown as 40, a positioning template 14 for cylinder mold 32, two vertical rods 16 on each side of positioning template 14 integrated into baseplate 10 and frame work 12, a cross-member 18 with mounted cutting apparatus 20 for vertical sliding movement, a lever arm 22 pivotally mounted on frame 12 through pin 28, a thrust link 24 pivotally connected to the cross-member 18 via pin 36 and to the lever arm 22 through pin 34, to transmit force to the cross-member 18 on movement of the lever arm 22 along the cutting path between test specimen 30 and plastic mold 32. A fixed extractor 26 mounted on top of positioning template 14 holds cylinder mold test specimen in place upon retraction of lever arm 22 also used to stop the cross member 18 to prevent cutting apparatus in to base plate. The positioning template 14 as shown forms a rest against which the concrete test specimen 30 may be placed and aligned to be positioned properly. As shown, it may have an arcuate surface to guide the cylindrical specimen closely.

In more detail, still referring to the invention of FIG. 1 to FIG. 5 the base plate 10 as shown includes two vertical rods 16 and frame work 12 securely fastened to base plate 10 conjoining at top and bottom to make a rigid frame. The cross-member 18 is guided by and slides up and down on vertical rods 16. By the up motion of the lever arm 22 connected to the cross-member 18 moving vertically with cutting apparatus 20 clears to place concrete mold 32 test and concrete specimen 30 into place up against positioning template 14 and siting on base plate 10. Applying down motion/pressure on to lever arm 22 forces cutting apparatuses 20 between concrete test specimen 30 and plastic mold 32, following thru in motion the cutter apparatuses 20 cuts the plastic mold 32 on two sides simultaneously. Sufficient force is applied to lever arm 22 to force cutter apparatuses 20 down to fixed extractor 26 also used as a stop to prevent cutting apparatus 20 tips into base plate. Up motion of the lever arm 22 retracts the cutting apparatuses 20 at the same time the molded test specimen 30,32 comes in contact with extractor 26 holding molded test specimen 30,32 in place as the cutting apparatus 20 continues up and clear of molded test specimen 30,32. The mold 32 may then be readily removed from the concrete test specimen 30 which may be sent to a test facility.

It is noted that the mold cutter may be sized up or down depending on the size of the mold to be cut.

While this invention may be embodied in many different forms, there are shown in the drawings and described in detail herein specific preferred embodiments of the invention. The present disclosure is an exemplification of the principles of the invention and is not intended to limit the invention to the particular embodiments illustrated.

The invention claimed is:

1. An apparatus for freeing a test cylinder of hardened concrete from a plastic mold comprising:

a) a baseplate with a framework to support a pair of opposed, parallel vertical rods;

b) a positioning template attached to said baseplate has an arcuate surface for guiding said test cylinder to proper alignment in said apparatus;

c) a cross-member slidably held to said vertical rods and adapted to move up and down captively on said vertical rods;

d) a lever arm pivotally connected to a top of said framework, which is vertically opposite said baseplate;

e) a pivoting link connected between said lever arm and said cross-member such that movement of said lever arm is configured to raise or lower said cross-member relative to said vertical rods;

f) two opposing cutting members are secured to said cross-member and positioned to cut two opposing sides of a plastic mold surrounding said test cylinder from a top to a bottom of said plastic mold, in a vertical movement, when said lever arm is depressed forcing said cross-member and attached cutting members downwardly on said plastic mold filled with hardened concrete that has been placed on said baseplate, and g) a substantially L-shaped extractor mounted to and above said positioning template to hold said concrete test cylinder in place upon retraction of said cutting members and also to stop said cross-member, to prevent the cutting members from cutting into said baseplate.

2. The apparatus of claim 1 wherein said extractor prevents continued downward movement of said cutting members to prevent the cutting members from reaching the baseplate.

3. An apparatus for freeing a test cylinder of hardened concrete from a plastic mold comprising:

a) a baseplate with a framework supporting a pair of opposed, parallel vertical rods;

b) a positioning template attached to said baseplate has an arcuate surface for guiding said test cylinder to proper alignment in said apparatus;

c) a cross-member slidably held to said vertical rods and adapted to move up and down captively on said vertical rods;

d) a lever arm pivotally connected to a top of said framework, which is vertically opposite said baseplate;

e) a pivoting link connected between said lever arm and said cross-member such that movement of said lever arm is configured to raise or lower said cross-member relative to said vertical rods; and f) a pair of opposing cutting members secured to said cross-member and positioned to cut a opposing sides of a plastic mold surrounding said test cylinder from a top to a bottom of said plastic mold, in a vertical movement, when said lever arm is depressed forcing said cross-member and attached cutting members downwardly on said plastic mold filled with hardened concrete that has been placed on said baseplate, and g) a substantially L-shaped extractor mounted to and above said positioning template to hold said test cylinder in place upon retraction of said cutting members and also to stop said cross-member, to prevent the cutting members from cutting into said baseplate.

* * * * *